United States Patent [19]

Fleming et al.

[11] Patent Number: 4,884,982

[45] Date of Patent: Dec. 5, 1989

[54] CAPACITIVE COUPLED CONNECTOR

[75] Inventors: David F. Fleming, Palmyra; Harold W. Kerlin, Port Royal; William V. Pauza, Palmyra; Wilmer L. Sheesley, Dauphin, all of Pa.

[73] Assignee: AMP Incorporated, Harrisburg, Pa.

[21] Appl. No.: 330,995

[22] Filed: Apr. 3, 1989

[51] Int. Cl.[4] ..... H01R 13/66

[52] U.S. Cl. ..... 439/620; 333/185

[58] Field of Search ..... 439/620; 333/181-185

[56] References Cited

U.S. PATENT DOCUMENTS

| | | | |
|---|---|---|---|
| 3,721,869 | 3/1973 | Paoli . | |
| 4,229,714 | 10/1980 | Yu . | |
| 4,242,655 | 12/1980 | Carlson et al. . | |
| 4,276,523 | 6/1981 | Boutros et al. . | |
| 4,329,665 | 5/1982 | Komaki et al. . | |
| 4,370,630 | 1/1983 | Capek et al. . | |
| 4,374,605 | 2/1983 | Bratt . | |
| 4,453,153 | 6/1984 | Capek et al. . | |
| 4,674,809 | 6/1987 | Hollyday et al. | 439/620 |
| 4,741,703 | 5/1988 | Johnescu et al. | 439/63 |
| 4,797,120 | 1/1989 | Ulery | 439/578 |

*Primary Examiner*—Gary F. Paumen

*Attorney, Agent, or Firm*—Gerald K. Kita

[57] ABSTRACT

A capacitive coupling includes a conductive clip 32 adapting to an outer profile of an electrical connector 1 and providing a capacitive coupling with multiple conduction paths through capacitor elements 33 held by the clip 32 in pressure engagement with a conductive shell 9 of the connector 1, the clip 32 further providing a voltage discharge path between the clip 32 and the shell 9.

4 Claims, 3 Drawing Sheets

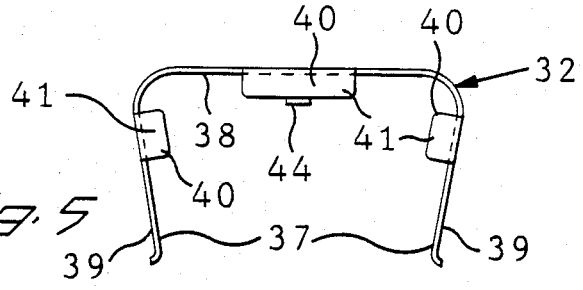
Fig. 5
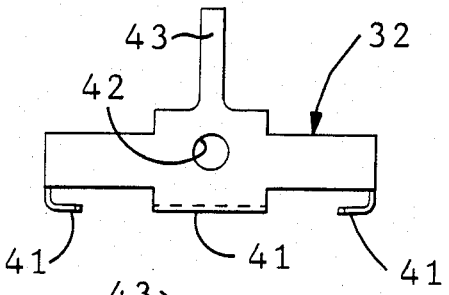
Fig. 6
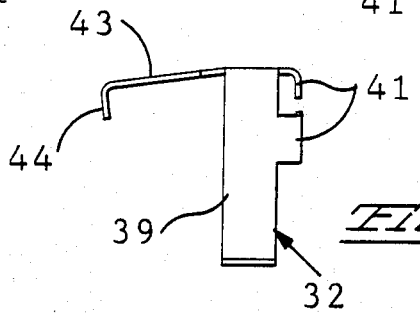
Fig. 7
Fig. 9
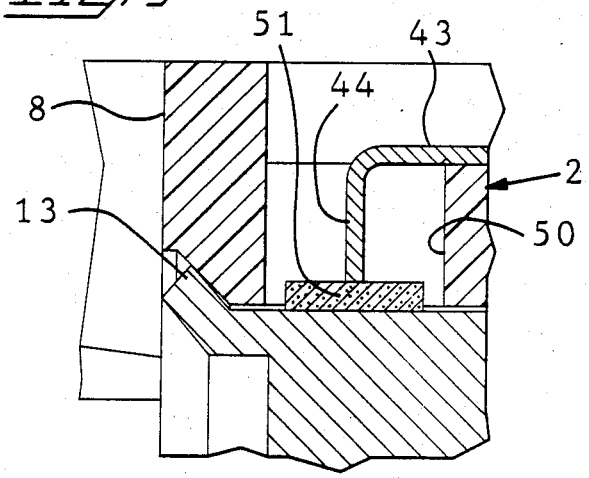
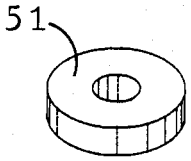
Fig. 8

CAPACITIVE COUPLED CONNECTOR

Each of the discussed advantages, features and and contributes to the use and importance of the invention.

FIELD OF THE INVENTION

The invention relates to an electrical connector for connection to a conductive panel, and more particularly, to features of the connector providing a capacitive coupling to the panel and a voltage discharge path.

BACKGROUND OF THE INVENTION

U.S. Pat. No. 4,797,120 discloses a known connector for mounting to a conductive panel and comprising, an insulated signal transmitting contact, an insulated conductive shell and a coupling portion for coupling the shell to the panel. The coupling portion is a device with an electrical filter and is externally secured to an electrical connector without regard to whether the device is within the profile of the connector.

SUMMARY OF THE INVENTION

A feature of the invention is disclosed by electrical capacitor elements in an electrical connector to provide a capacitive coupling of a conductive shell of the connector to a conductive panel, while an outer profile of the connector has the same dimensions as that of a known connector without the capacitor elements. The known connector is referred to as a standard connector. By maintaining the same outer dimensions, the connector with a capacitive coupling feature is easily substituted for the standard connector for use in an allotted, confined space.

An objective of the invention is to adapt an electrical connector for capacitive coupling with a panel. Another objective is to adapt an electrical connector for capacitive coupling with a panel, while maintaining the same dimensions as a standard connector without a capacitive coupling feature.

According to another feature of the invention, an electrical connector of familiar dimensions is adapted with a conductive clip for inset along outer limits of the outer profile of the connector. The clip holds electrical capacitor elements in pressure engagement against a conductive shell of the connector to provide capacitive coupling of the shell and an external conductive panel contacting the connector. An advantage of the clip is that the clip exerts a spring force to maintain pressure engagement of the capacitor elements against the shell despite the force reducing effect of torque applied to the connector, metal creep to relieve stress and other dimensional changes with the passage of time.

Another feature of the invention is to adapt an electrical connector with a conductive clip for holding multiple, spaced apart capacitor elements in pressure contact with a conductive shell of the connector, the clip having multiple, spaced apart contact surfaces distributed along the clip and providing distributed electrical coupling paths from the shell, through the capacitor elements, and to a conductive panel contacting the clip. The distributed electrical paths reduce the likelihood of high electrical resistance at the coupling of the connector with the panel.

Another feature of the invention resides in a capacitive coupling comprising a conductive clip adapting to an outer profile of an electrical connector and providing a capacitive coupling with multiple conduction paths through capacitor elements held by the clip in pressure engagement with a conductive shell of the connector, the clip further providing a voltage discharge path between the clip and the shell.

These and other advantages, features and objectives of the invention are disclosed by way of example from the following detailed description and accompanying drawings.

DESCRIPTION OF THE DRAWINGS

FIG. 5 is a front view of a clip.

FIG. 6 is a top plan view of the clip shown in FIG. 5.

FIG. 7 is a side view of the clip shown in FIG. 5.

FIG. 8 is a perspective view of a ceramic wafer.

FIG. 9 is a fragmentary view in section of a portion of the connector shown in FIG. 2 and the wafer shown in FIG. 8.

DETAILED DESCRIPTION OF THE INVENTION

Figure 1:
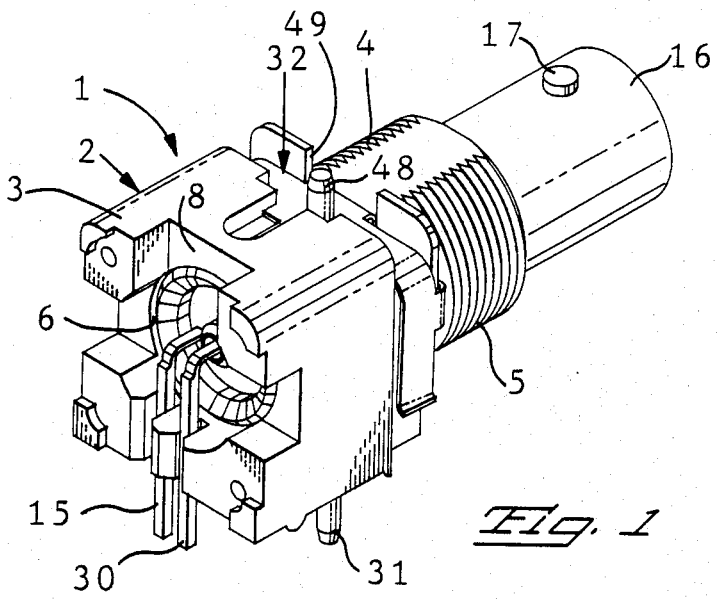
FIG. 1 is a perspective view of a connector adapted for providing a capacitive coupling to a panel.

With reference to FIG. 1, an electrical connector 1 includes an insulative body 2 fabricated, for example, by moulding, and includes an enlarged portion 3, the outer dimensions of which are of block rectangular profile, and a unitary cylindrical portion 4 with external threads 5. A hollow interior portion 6 extends axially through the portions 3 and 4, and through a front end 7 of the portion 4, and through a rear end 8 of the portion 3.

A conductive, stepped, outer cylindrical shell 9 is within the hollow interior portion 6. An external projecting key 10 of the shell 9 extends along a keyway 11 in the body 2 etending from the front end 7. Relative movement of the shell 9 is prevented by a rear facing shoulder 12 of the shell 9 that faces the front end 7, and by a thin flange 13 of a rear end of the shell 9 outwardly flared, after insertion into the hollow interior portion 6, to engage against a flared rear of the interior portion 6. An elongated inner electrical terminal 15 imbedded in the shell 9 projects for pluggable receipt in a corresponding aperture, not shown of a printed circuit board, PCB.

A disconnect coupling portion 16 of a front portion of the shell 9 projects axially forward of the body 2 and is provided with bayonet coupling prongs 17 for disconnect coupling with a complementary connector, not shown.

A hollow insulative liner 18 for the shell 9 is known as a dielectric and extends within an axial, stepped cylindrical passage 19 concentrically of the shell 9. An external step shoulder 20 of the liner 18 engages an interior, front facing, step shoulder 21 of the shell 9. A forward portion 22 of the liner 18 is of reduced diameter and projects concentrically into the disconnect coupling portion 16 of the shell 9.

A conductive electrical contact 23, known as a center contact, of stamped and formed metal strip extends concentrically within the liner 18 along a stepped passage 24 of the liner 18. A unitary, disconnect contact portion 25 includes a hollow cylindrical electrical receptacle formed by bending the strip into a hollow cylindrical shape. An open front end 26 of the contact portion 25 faces forward and is concentrically within the liner 18. An elongated portion 27 of the contact 23 extends concentrically along a reduced diameter portion 28 of the passage 24 and projects beyond a rear end 29 of the liner 18 to provide an electrical terminal 30 for pluggable receipt in a corresponding PCB aperture, not shown. Conductive posts 31 are imbedded in the body 2 and extend in the same direction as that of the terminal 30 for pluggable receipt into additional PCB apertures, not shown.

Figure 3:
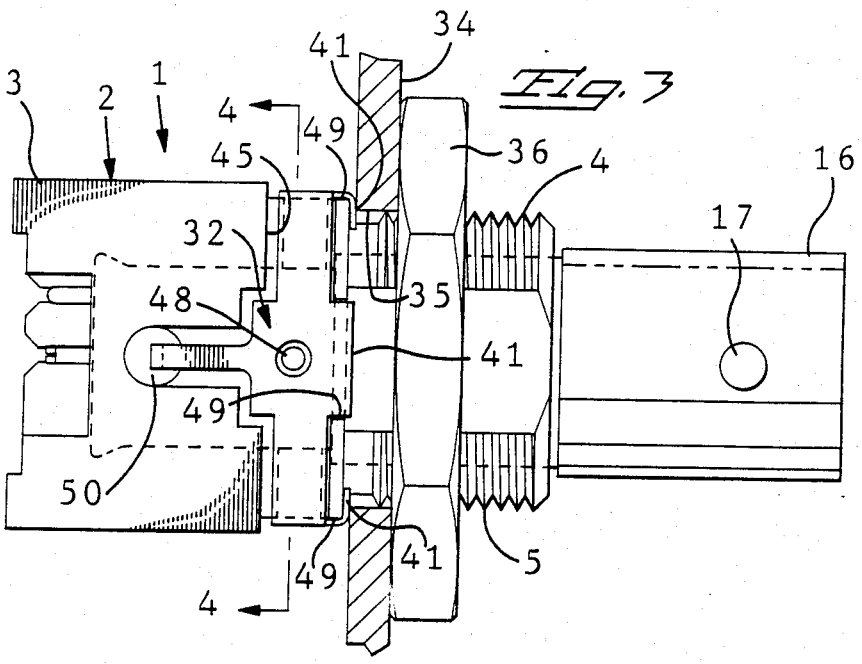
FIG. 3 is a top plan view of the connector shown in FIG. 1.
Figure 4:
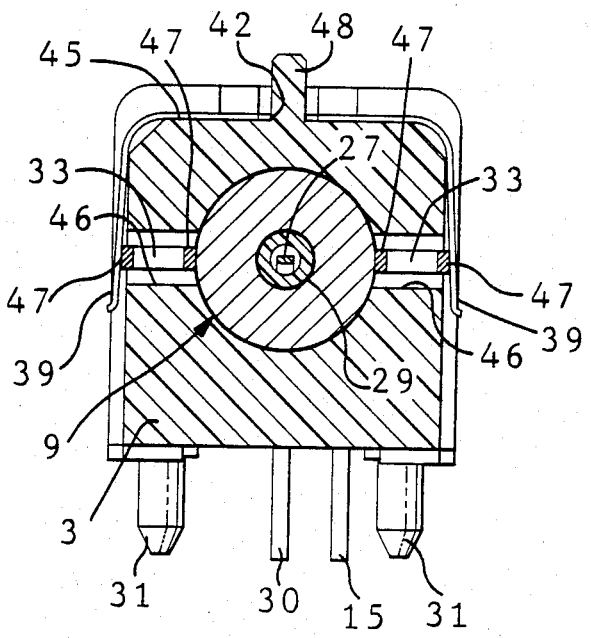
FIG. 4 is a section view taken along the line 4—4 of FIG. 3.

The connector 1 is a BNC type coaxial connector and has an exterior profile of dimensions the same as that of a known BNC type connector. The connector 1 is adapted with a conductive clip 32 and multiple capacitor elements 33, FIG. 4, to provide a capacitive coupling of the shell 9 with a conductive panel 34, FIG. 3. The capacitive coupling will discharge a voltage from the shell 6 to the panel 34 and will allow a voltage of the shell 9 to be capacitive coupled with a corresponding voltage of the panel 34. The cylindrical portion 4 extends through an opening 35 of the panel 34, and an internally threaded nut 36 is threaded onto the threads 5 to press the clip 32 in pressure contact with the panel 34.

According to FIGS. 5–7, the clip 32 is spring resilient, and is fabricated from a stamped and formed, unitary metal strip of relatively thin thickness. The clip 32 includes a curvilinear yoke 37 having a bight 38 and spaced apart arms 39 inclined toward each other. Tabs 40 extend from a forward edge of the yoke 37 and are distributed along a length of the yoke 37, and are bent across the thickness to provide conductive electrical contact surfaces 41 that are coplanar with one another. An opening 42 through the bight 38 extends through the thickness. A cantilever beam 43 extends rearward from the bight 38 and is bent across the thickness to project a tip 44 of the beam 43 transversely to the arm 39

The block rectangular portion 3 is provided with an external recess 45 inset into the outer profile of the connector 1. The recess 45 is shaped to receive the outer edges of the clip 32 and to inset the clip 32 within the outer profile. A corresponding, capacitor receiving, cavity 46 extends into the block rectangular portion 3 and intersects the recess 45 and an exterior of the shell 9. A corresponding capacitor element 33 of known, commercially available form is assembled in a corresponding cavity 46, and has integral conductive contacts 47, respectively engaged against the shell 9 and against the clip 32.

The clip 32 can be assembled on the body 2 in the absence of a corresponding capacitor element 33. The arms 39 are deflected pivotally away from each other by the body 2 between the arms 39, causing a spring bias that retains the clip 32 in place. Later, the clip 32 can be removed to permit assembly of a corresponding capacitor element 33 in a corresponding cavity 46. The clip 32 is again assembled on the body 2.

Figure 2:
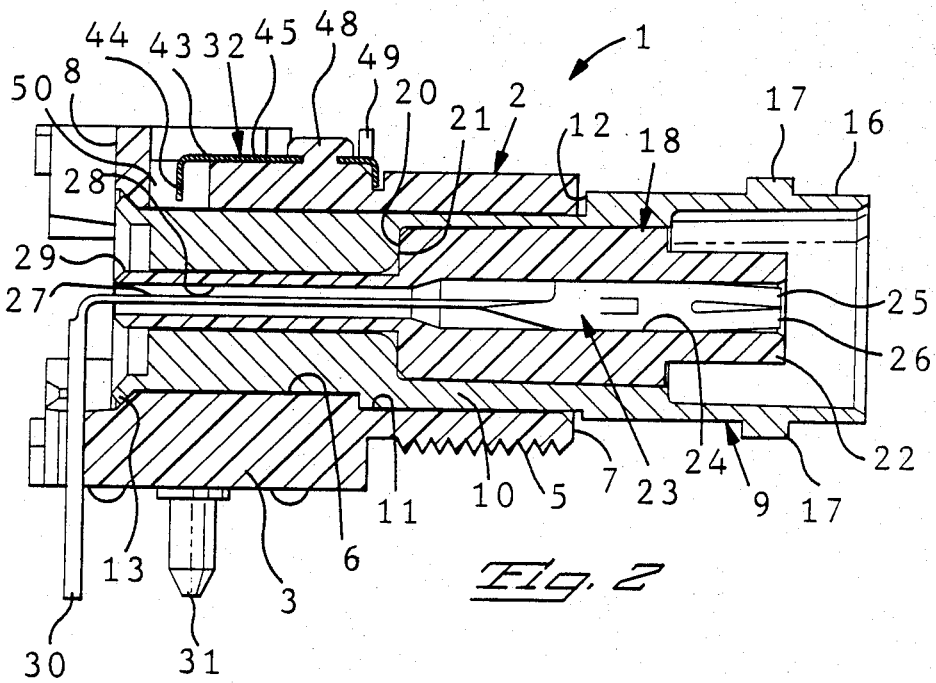
FIG. 2 is a longitudinal view in section of the connector shown in FIG. 1.

The body 2 has a peg 48 projecting from the bottom of the recess 45 and through the opening 42 in the bight 38 of the clip 32. An enlarged rivet head, FIG. 2, is formed on the peg 48 by the application of heat and pressure to overlie and retain the clip 32.

Each corresponding capacitor element 33 projects from a corresponding cavity 46 into the recess 45, and urges against a corresponding arm 39 of the clip 32, tending to deflect the arm 39 pivotally away from the other arm 39. In turn, the corresponding arm 39 urges a corresponding capacitor element 33 toward the shell 9 by a spring bias caused by deflection of the arm 39. Thereby, each corresponding capacitor element 33 is held by the clip 32 in pressure engagement with the shell 9. Further thereby, the clip 32 exerts a spring force to maintain pressure engagement of each corresponding capacitor element 33 with the shell 9 and with the clip 32.

The tabs 40 extend through corresponding channels 49 extending from the recess 45 to a front of the block rectangular portion 3 and overlap the front. When the nut 36 is tightened, the contact surfaces 41 of the tabs 40 are in pressure contact with the panel 34.

Attention is directed to a feature that protects the connector 1 from exposure to elevated voltages that would cause degradation of the insulative parts. If the capacitor elements 33 are present, they too are protected from elevated voltages. The beam 43 of the clip 32 is positioned against the bottom of the recess 45 with a slight spring pressure. Thereby the tip 44 of the beam 43 is positioned to extend along a spark gap opening 50 in the bottom. A surface area of the shell 9 is exposed by the opening 50. A gap of precise width separates the shell 9 and the positioned tip 44, and provides a voltage discharge path from the shell 9, across the gap, and through the clip 32 to the panel 34. An insulator 51 of selected dielectric strength and composition is present in the gap. The insulator 51 prevents discharge of a voltage across the gap until a voltage of the shell 9 exceeds a threshold level that causes discharge of the voltage across the gap. The discharged voltage is conducted from the shell 9 and along the clip 32 to the panel 34. Thereby, the voltage is dissipated. For example, the insulator 51 can be air or a known, commercially available wafer, FIG. 8, of a solid material incapable of forming paths of conductive material that has been vaporized by discharge of the elevated voltage. Suitable material includes, glass, mica or ceramic, manufactured as the wafer 51 especially for discharge of a voltage across a gap of specific width. The tip 44 of the beam 43 engages the wafer 51 and retains the wafer 51 in the gap by a spring force provided by the beam 43. The wafer 51 is in pressure contact with the beam 43 and the shell 9. Care is taken to enlarge the opening 50 to prevent formation of conductive paths caused by vaporized material of the body 2 during discharge of a voltage across the gap.

We claim:

1. In an electrical coaxial connector for mounting to a conductive panel and comprising, an insulated inner signal transmitting contact, an insulated outer conductive shell and a coupling portion for coupling the shell to the panel, wherein the improvement comprises:

electrical capacitor elements inset within an outer profile of the connector, a conductive clip inset within the outer profile and holding said capacitor elements in pressure contact with said shell, and contact surfaces of said clip establishing a capacitive electrical coupling of said shell and the panel by engaging the panel.

2. An electrical connector as recited in claim 1, wherein the improvement comprises:

the capacitor elements are spaced apart from one another.

3. An electrical connector as recited in claim 1, wherein the improvement comprises:

the contact surfaces are distributed along the length of the clip to provide distributed coupling paths from the shell, through the capacitor elements and to the panel.

4. An electrical connector as recited in claim 1, wherein the improvement comprises:

a voltage discharge path defined by an edge of the clip separated by a gap from the shell, and by an insulator having a selected dielectric constant in the gap.

* * * * *